US007581498B2

(12) United States Patent
Hetz et al.

(10) Patent No.: US 7,581,498 B2
(45) Date of Patent: Sep. 1, 2009

(54) INJECTION MOLDED SHAPED CHARGE LINER

(75) Inventors: Avigdor Hetz, Houston, TX (US); Clarence W. Wendt, Bellville, TX (US); John D. Loehr, Needville, TX (US)

(73) Assignee: Baker Hughes Incorporated, Houston, TX (US)

( * ) Notice: Subject to any disclaimer, the term of this patent is extended or adjusted under 35 U.S.C. 154(b) by 260 days.

(21) Appl. No.: 11/210,200

(22) Filed: Aug. 23, 2005

(65) Prior Publication Data

US 2007/0053785 A1 Mar. 8, 2007

(51) Int. Cl.
*F42B 1/02* (2006.01)

(52) U.S. Cl. ..... 102/306; 419/36

(58) Field of Classification Search ..... 102/306; 419/36, 40, 66

See application file for complete search history.

(56) References Cited

U.S. PATENT DOCUMENTS

| | | | | |
|---|---|---|---|---|
| 4,338,713 | A | 7/1982 | Christopher | |
| 4,613,370 | A | 9/1986 | Held et al. | |
| 5,221,808 | A | 6/1993 | Werner et al. | |
| 5,413,048 | A | 5/1995 | Werner et al. | |
| 5,567,906 | A | 10/1996 | Reese et al. | |
| 5,656,791 | A | 8/1997 | Reese et al. | |
| 5,814,758 | A | 9/1998 | Leidel | |
| 6,204,316 | B1 | 3/2001 | Schofalvi | |
| 6,296,044 | B1 | 10/2001 | Brooks et al. | |
| 6,350,407 | B1 | 2/2002 | Sakata et al. | |
| 6,371,219 | B1 | 4/2002 | Collins et al. | |
| 6,530,326 | B1 | 3/2003 | Wendt, Jr. et al. | |
| 6,705,848 | B2 | 3/2004 | Scancarello | |
| 6,776,955 | B1 * | 8/2004 | Lim et al. | 419/36 |
| 7,413,702 | B2 | 8/2008 | Lu et al. | |

FOREIGN PATENT DOCUMENTS

| | | |
|---|---|---|
| WO | WO 01/96807 A2 | 12/2001 |

(Continued)

OTHER PUBLICATIONS

Theodore Baumeister, Eugene A. Avallone, Mark's Standard Handbook for Mechanical Engineers, Eight Edition, pp. 13-22 and 13-23, McGraw-Hill Book Company, (1978).

(Continued)

*Primary Examiner*—George Wyszomierski
*Assistant Examiner*—Weiping Zhu
(74) *Attorney, Agent, or Firm*—Bracewell & Guiliani LLP

(57) ABSTRACT

A shaped charge liner formed by injection molding, where the liner components include powdered metal and organic binder. The liner components are blended then processed within an injection molding device and urged from the molding device into a mold where a liner shape is formed. The liner shape is debinded, both mechanically and chemically. Mechanical debinding involves heating and chemical debinding comprises treating the liner shape with a solution to dissolve and remove the binder components. The process of forming the shaped charge liner does not include sintering. The present process can also use "green products" formed by the injection molding device that are not debinded. A shaped charge case can also be formed using the present method. The added step of sintering can be applied to the process of forming the shaped charge case.

29 Claims, 6 Drawing Sheets

FOREIGN PATENT DOCUMENTS

WO WO 2005/035929 A2 4/2005

OTHER PUBLICATIONS

PIM International, Metal Injection Moulding/Molding—An Introduction, pp. 3-4, http://www.pim-international.com/ aboutpim.

European Communication pursuant to Article 94(3) EPC, Oct. 30, 2008, 8 pages.

Website http://metaor-imc.com/materials/materials.htm, MIM Technology.

* cited by examiner

INJECTION MOLDED SHAPED CHARGE LINER

BACKGROUND OF THE INVENTION

1. Field of the Invention

The invention relates generally to the field of oil and gas production. More specifically, the present invention relates to a method of producing a shaped charge liner from an injection molding process.

2. Description of Related Art

Perforating guns are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore.

Shaped charges known in the art for perforating wellbores are used in conjunction with a perforation gun. One embodiment of a traditional shaped charge 5 is illustrated in FIG. 1. As shown, shaped charge 5 includes a housing 6, a liner 10, and a quantity of high explosive 8 inserted between the liner 10 and the housing 8 where the high explosive 8 is usually HMX, RDX PYX, or HNS. When the high explosive 8 is detonated, the force of the detonation collapses the liner 10 and ejects it from one end of the charge at very high velocity in a pattern called a "jet". The jet penetrates the casing, the cement and a quantity of the formation.

Some of the traditional methods of producing shaped charge liners include sintering and cold working. Cold working involves mixing a powdered metal mix in a die and compressing the mixture under high pressure into a shaped liner. Typically, these liners comprise a composite of two or more different metals, where at least one of the powdered metals is a heavy or higher density metal, and at least one of the powdered metals acts as a binder or matrix to bind the heavy or higher density metal. Examples of heavy or higher density metals used in the past to form liners for shaped charges have included tungsten, hafnium, copper, or bismuth. Typically the binders or matrix metals used comprise powdered lead, however powdered bismuth has been used as a binder or matrix metal. While lead and bismuth are more typically used as the binder or matrix material for the powdered metal binder, other metals having high ductility and malleability can be used for the binder or matrix metal. Other metals which have high ductility and malleability and are suitable for use as a binder or matrix metal comprise zinc, tin, uranium, silver, gold, antimony, cobalt, copper, zinc alloys, tin alloys, nickel, and palladium.

One of the problems associated with cold working a liner is a product having inconsistent densities. This is usually caused by migration of either the binder or the heavy metal to a region thereby producing a localized density variation. A lack of density homogeneity curves the path of the shaped charge jet that in turn shortens the length of the resulting perforation. This is an unwanted result since shorter perforations diminish hydrocarbon production. Moreover, cold worked liners have a limited shelf life since they are susceptible to shrinkage thereby allowing gaps to formed between the liners and the casing in which they are housed. These liners also tend to be somewhat brittle which leads to a fragile product.

Sintered liners necessarily involve a heating step of the liner, wherein the applied heating raises the liner temperature above the melting point of one or more of the liner constituents. The melted or softened constituent is typically what is known as the binder. During the sintering step, which is typically performed in a furnace, the metal powders coalesce while their respective grains increase in size. The sintering time and temperature will depend on what metals are being sintered.

The sintering process thus forms crystal grains thereby increasing the final product density while lowering the porosity. Typically sintering is performed in an environment void of oxygen or in a vacuum. However the ambient composition within a sintering furnace may change during the process, for example the initial stages of the process may be performed within a vacuum, with an inert gas added later. Moreover, the sintering temperature may be adjusted during the process, wherein the temperature may be raised or lowered during sintering.

Prior to the sintering step the liner components can be cold worked as described above, injection molded, or otherwise formed into a unitary body. However the overall dimensions of a sintered liner can change up to 20% from before to after the sintering step. Because this size change can be difficult to predict or model, consistently producing sintered shaped charge liners that lie within dimensional tolerances can be challenging. Information relevant to shaped charge liners formed with powdered metals is addressed in Werner et al., U.S. Pat. No. 5,221,808, Werner et al., U.S. Pat. No. 5,413,048, Leidel, U.S. Pat. No. 5,814,758, Held et al. U.S. Pat. No. 4,613,370, Reese et al., U.S. Pat. No. 5,656,791, and Reese et al., U.S. Pat. No. 5,567,906.

Therefore, there exists a need for a method of consistently manufacturing shaped charge liners, wherein the resulting liners have a homogenous density, have consistent properties between liner lots, have a long shelf life, and are resistant to cracking.

BRIEF SUMMARY OF THE INVENTION

The present invention involves a method of forming a shaped charge liner comprising, creating a mixture of metal powder and a binder, molding the mixture into a liner shape with an injection molding device, and debinding the binder from the liner shape thereby forming a liner. The metal powder can be tungsten, uranium, hafnium, tantalum, nickel, copper, molybdenum, lead, bismuth, zinc, tin, silver, gold, antimony, cobalt, zinc alloys, tin alloys, nickel, palladium, coated metal particles. The metal powder can be chosen from these listed metals singularly or can come from combinations thereof.

The binder can be a polyolefine, an acrylic resin, a styrene resin, polyvinyl chloride, polyvinylidene chloride, polyamide, polyester, polyether, polyvinyl alcohol, paraffin, higher fatty acid, higher alcohol, higher fatty acid ester, higher fatty acid amide, wax-polymer, acetyl based, water soluble, agar water based and water soluble/cross-linked. The binder can be chosen from these listed binders singularly or can come from combinations thereof.

The step of debinding can include chemical debinding as well as thermal debinding wherein the step of debinding can comprise treating the liner shape with a debinding agent. The debinding agent can be water, nitric acid, organic solvents, as well as combinations thereof. The method can further include heating the liner shape thus removing additional binder from the liner shape.

The present method disclosed herein further comprises forming a shaped charge with the shaped charge liner, disposing the shaped charge within a perforating gun, combining the perforating gun with a perforating system, disposing the perforating gun within a wellbore, and detonating the shaped charge.

An alternate method of forming a shaped charge liner is disclosed herein comprising, combining powdered metal with organic binder to form a mixture, passing the mixture through an injection molding device, ejecting the mixture from the injection molding device into a mold thereby forming a liner shape in the mold, and debinding the binder from the liner shape; wherein the liner shape is sintered. The alternate method further comprises placing the liner shape in a vacuum. The alternate method of forming a shaped charge liner may also comprise forming a shaped charge with said shaped charge liner, disposing the shaped charge within a perforating gun, combining the perforating gun with a perforating system, disposing the perforating gun within a wellbore, and detonating the shaped charge.

A yet another alternative method of forming a shaped charge liner is disclosed herein that comprises forming a mixture by combining metal powder with a binder, processing the mixture with an injection molding apparatus, discharging the mixture into a mold thereby forming the liner, and removing the liner from the mold. In this alternative method of forming a shaped charge liner, the liner formed in the mold can be a "green product".

Also included with this disclosure is a method of forming a shaped charge case. The method of forming a shaped charge case comprises creating a mixture of metal powder and a binder, molding the mixture into a charge case shape with an injection molding device, and debinding the binder from the charge case shape to form a shaped charge case. The metal powder used in forming the shaped charge case can be the same as those used in the liners further including, stainless steel, carbon steel, and aluminum. The method of forming a shaped charge case can include a binder such as a polyolefin, an acrylic resin, a styrene resin, polyvinyl chloride, polyvinylidene chloride, polyamide, polyester, polyether, polyvinyl alcohol, a paraffin, a higher fatty acid, a higher alcohols, a higher fatty acid ester, a higher fatty acid amide, a wax-polymer, and combinations of these items. The method of forming a shaped charge case can further comprise chemical debinding and thermal debinding, where the step of debinding further comprises treating the liner shape with a debinding agent. The debinding agent can be water, nitric acid, organic solvents, or a combination thereof. The method of forming a charge case can further comprise heating the charge case shape thereby removing remaining binder from the charge case shape. The charge case formed with the method disclosed herein can further include disposing the shaped charge within a perforating gun, combining the perforating gun with a perforating system, disposing the perforating gun within a wellbore, and detonating the shaped charge. Additionally, the case formed in the injection molding device can be a green product.

DETAILED DESCRIPTION OF THE INVENTION

The present disclosure involves a shaped charge liner and a method of making the shaped charge liner. The method disclosed herein involves a form of metal injection molding wherein metal powders are mixed with binders and the mixture is subsequently injected under pressure into a mold. The binder is then removed during a de-binding process in order to form the final product.

Figure 2:
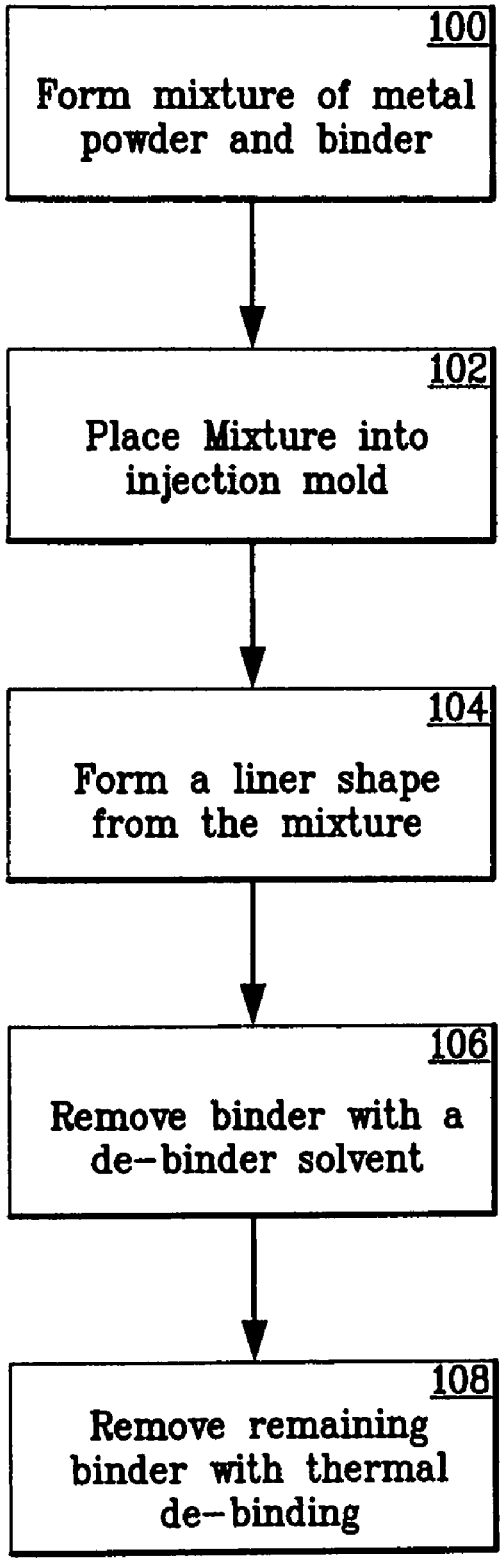
FIG. 2 represents in flow chart form an embodiment of a liner forming process.

With reference now to FIG. 2, one embodiment of a method in accordance with the present invention is shown in flow chart form. Initially an amount of metal powder is combined with an amount of binder to form a mixture (step 100). The amount of metal powder of the mixture can range from about 20% up to about 100%, therefore the amount of binder will range from about 0% to about 20%. The particulate size of the powdered metal can range from about 1 micron to in excess of 70 microns. The powdered metal can be chosen from the list comprising: tungsten, uranium, hafnium, tantalum, nickel, copper, molybdenum, lead, bismuth, zinc, tin, silver, gold, antimony, cobalt, zinc alloys, tin alloys, nickel, palladium, and combinations thereof. Optionally, in place of the powdered metal, other materials such as ceramic, high density polymers, or cementitious materials can be substituted. Another option is to use a coated powder metal, where the coating typically comprises a metal whose hardness is less than that of the particle being coated.

The binder can be selected from the list comprising: polyolefines such as polyethylene, polypropylene, polystyrenes, polyvinyl chloride, polyetheylene carbonate, polyethylene glycol, microcrystalline wax, ethylene-vinyl acetate copolymer and the like; acrylic resins such as polymethyl methacrylate, polybutyl methacrylate; styrene resins such as polystyrene; various resins such as polyvinyl chloride, polyvinylidene chloride, polyamide, polyester, polyether, polyvinyl alcohol, copolymers of the above; various waxes; paraffin; higher fatty acids (e.g., stearic acid); higher alcohols; higher fatty acid esters; higher fatty acid amides. Other binder possibilities include: acetyl based, water soluble, agar water based and water soluble/cross-linked; acetyl based binders comprise polyoxymethylene or polyacetyl with small amounts of polyolefin. The use of metal injection molded binders is well known and thus the size of the binder particulate can vary depending on the type of binder and/or the application. Accordingly, choosing a proper binder particulate size is within the scope of those skilled in the art.

Figure 3:
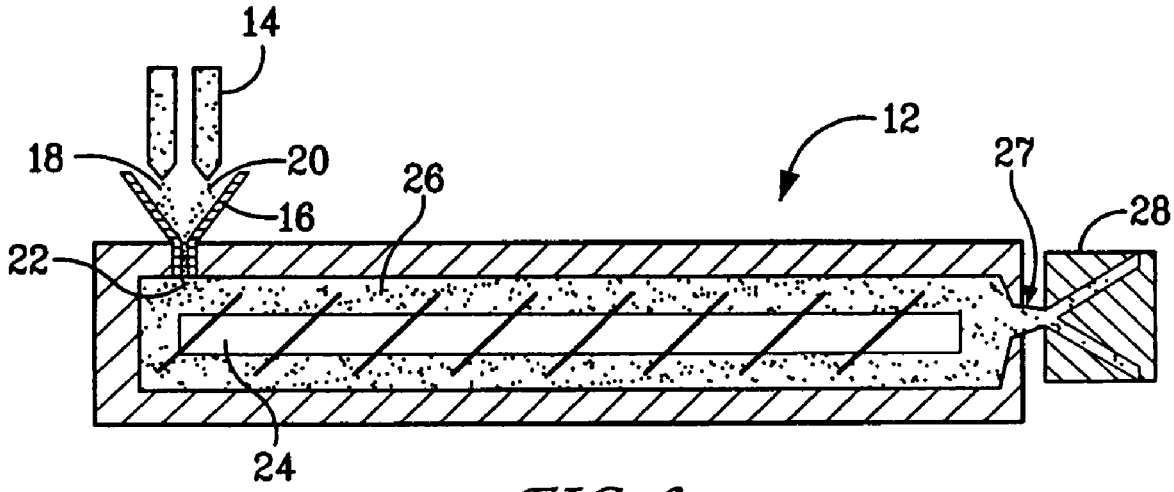
FIG. 3 illustrates a cross sectional view of an injection molding device.

Upon forming the mixture 22 of the metal powder and binder the mixture 22 is placed into an injection mold (step 102). One embodiment of the injection molding device 12 is shown in FIG. 3. As shown in this embodiment of the injection molding device 12, both the powder 18 and the binder 20 are directed through respective dispensers 14 to a chute 16, where the chute in turn guides the mixture 22 into the injection molding device 12. The mixture 22 can be formed within the chute 16, the injection molding device 12, or alternatively, the mixture 22 can be formed prior to being directed into the chute 16. Once inside the injection molding device 12, the mixture 22 is within the plenum 26 of the injection molding device 12. Rotation of an auger 24 disposed within the plenum 26 agitates the mixture thereby insuring a uniformity of the mixing of the binder and powder. The auger action also directs the mixture towards an exit port 27 disposed on the side of the injection molding device 12 distal from the chute 16. Moreover, the auger 24 provides a source of pressure for urging the mixed and homogenous mixture 22 from within the plenum 26 through the exit port 27 and into the inner confines of a mold 28. As is known, urging the mixture 22 into the mold 28 under pressure thereby can form a liner shape 30 having the constituents of the mixture 22 (step 104).

Figure 4:
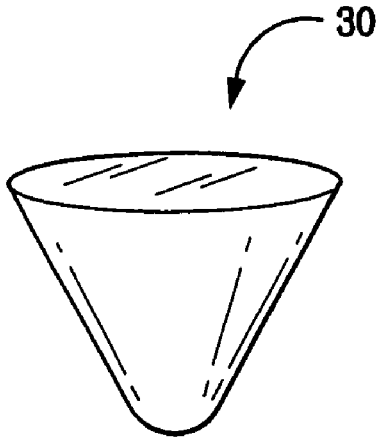
FIG. 4 portrays a side view of a liner shape.

One embodiment of a liner shape 30 is shown in FIG. 4. It should be pointed out that this liner has but one of the possible shapes that could be formed from the mixture 22 described herein. With regards to an actual liner 10 made in accordance with the method and process described herein, any liner shape could be formed with this process. Shapes such as conical frusto-conical, triangular, tulip and trumpet shape, and parabolic shapes, to name but a few, are considered within the scope and purview of the present invention.

Upon removal of the liner shape 30 from the mold 28 the process of de-binding the binder is undertaken. This can be done both chemically, i.e. with solvents or liquids, and thermally by heating the liner shape. It is preferred that the first step of de-binding occurs with a debinding liquid or solvent (step 106). This step involves chemically dissolving the organic binder with the de-binding liquid. Debinding can occur at atmosphere or under vacuum. The debinding solutions for use with the present method include water, nitric acid, and other organic solvents. However any suitable debinding solution can be used with the present method and skilled artisans are capable of choosing an appropriate debinding solution. During debinding, the liner shape 30 can be sprayed with the de-binding liquid or placed in a bath of de-binding solution.

After the liner shape 30 is processed with the liquid de-binding solution, the remaining binder is removed during a thermal de-binding process (step 108). The thermal de-binding process involves placing the liner shape into a heated unit, such as a furnace, where it is heated at temperature for a period of time. With regard to the de-binding temperature, it should be sufficient to cause it to melt any remaining binder within the liner that remains after the chemical de-binding step of step 106 and yet be low enough to not exceed the melting point of a metal powder used as part of the liner constituency. It is believed as well within the capabilities of those skilled in the art to determine a proper temperature and corresponding heating time to accomplish this process. It is should be pointed that with regard to the process described herein the final step of forming a liner 10*a* is the de-binding process. Unlike many traditional metal injection molding processes, a sintering process is typically implemented after the debinding step. Thus although the present method does not include a step of sintering, the advantages of a forming a homogenous liner 10*a* whose density is substantially consistent along its length can be realized by the unique process disclosed herein. Moreover, without the added sintering step, the final product will have dimensions substantially the same as that of the liner shape 30. Other advantages afforded by the present method are that liners formed in subsequent moldings or lots will have consistent characteristics and properties. Also, the present method provides liners have an enhanced shelf life and reduces the susceptibility of the liners to the cracking problems of liners formed from prior art methods.

As is known, a green part is the intermediate product taken from an injection mold prior to the de-binding process. With regard to the present disclosure, the green part is shown in FIG. 4 as a shaped liner 30. In an alternative process and an alternative apparatus, the green part shape liner 30 could be used as the final product liner in a shape charge 5*a*. Accordingly instead of a liner that had its binder removed during a de-binding process (step 106, step 108), in an alternative embodiment the shaped charge would have a shaped liner 30 for use as its liner. One of the advantages of using a green part is that the issue of shrinkage during subsequent heating is removed. Accordingly the size of the mold 28 could be more accurate in conforming to the required size of the final product.

Figure 5:
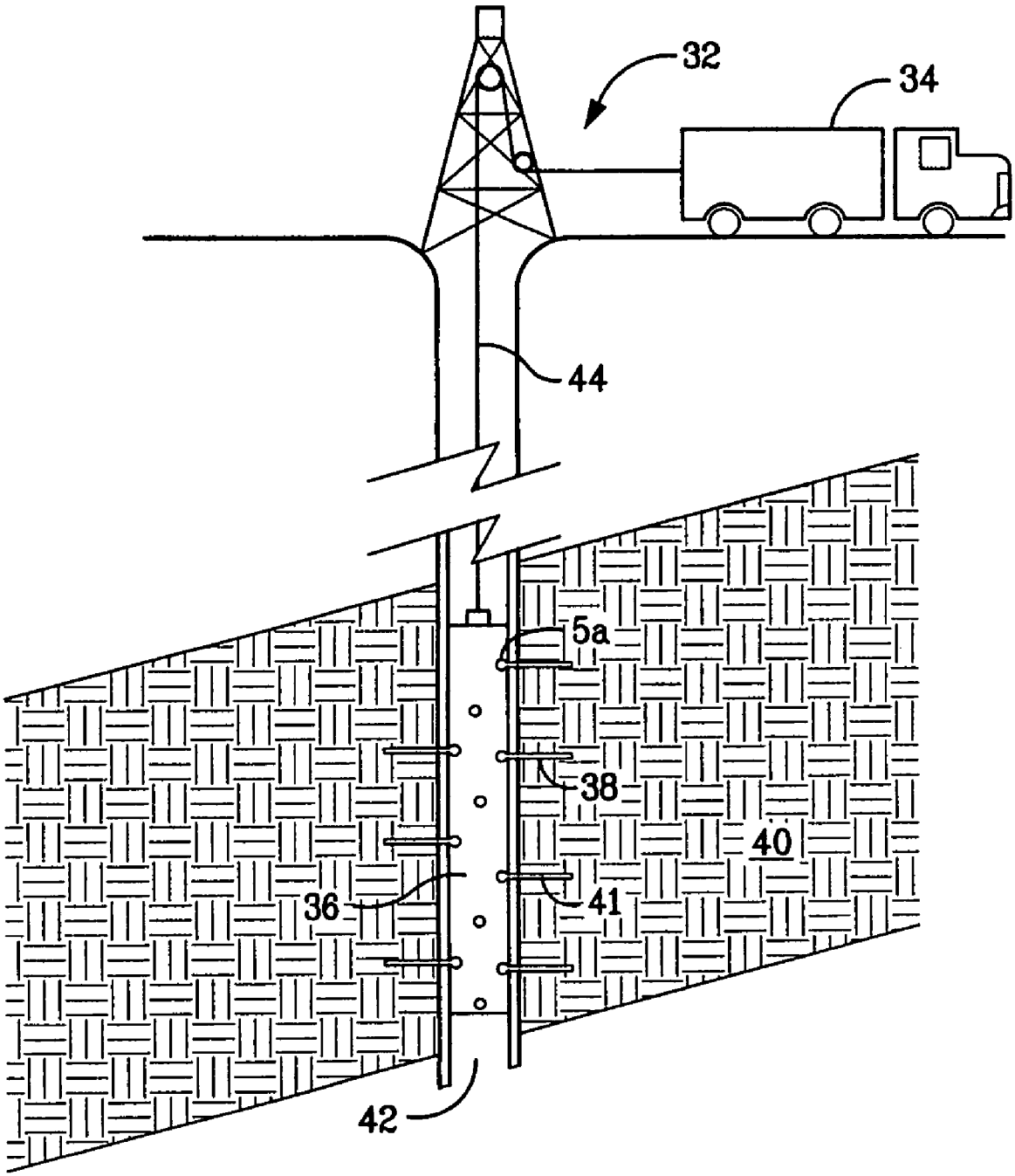
FIG. 5 is a cut away view of a perforating system with detonating shaped charges.

With reference now to FIG. 5 one embodiment of the final product of the present disclosure is shown combined with a perforating system 32. The perforating system 32 comprises a perforating gun 36 disposed within a wellbore 42 by a wireline 44. As shown, the surface end of the wireline 44 is in communication with a field truck 34. The field truck 34 can provide not only a lowering and raising means, but also the firing controls for detonation of the shaped charges of the perforating gun 36. With regard to this embodiment, the liner 10*a* is made in accordance with the disclosure herein is combined with a shaped charge 5*a* that is disposed in the perforating gun 36. Also shown are perforating jets 38, created by detonation of each shaped charge 5*a* thereby creating perforations 41 within the formation 40 surrounding the wellbore 42. Accordingly the implementation of the more homogenous and uniform liner material made in accordance with the method described herein is capable of creating longer and straighter perforations 41 into the accompanying formation 40.

Figure 1:
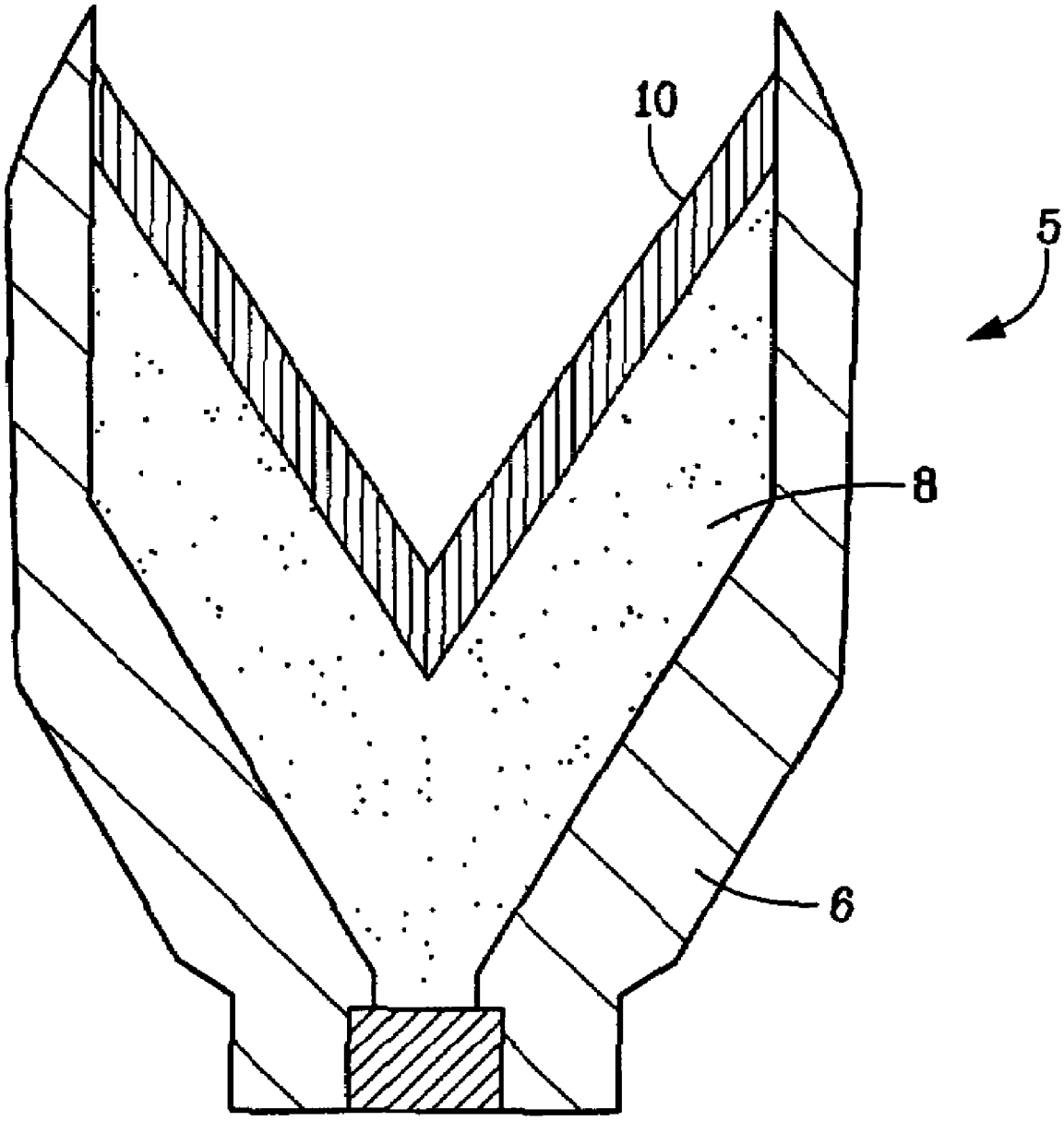
FIG. 1 depicts a perspective cross sectional view of a shaped charge.
Figure 6:
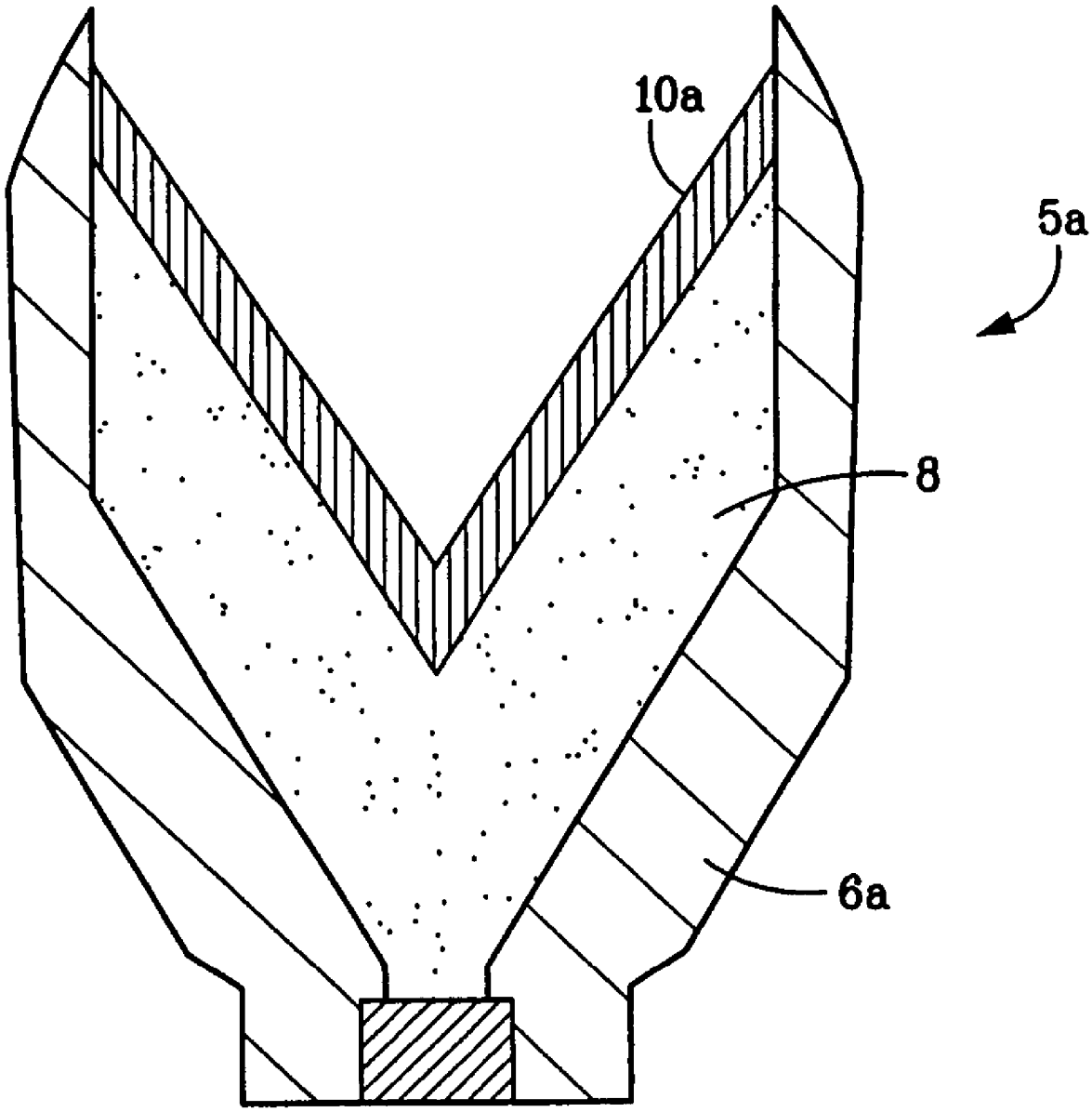
FIG. 6 is a cross sectional view of an embodiment of a shaped charge having a liner formed by the process described herein.
Figure 7:
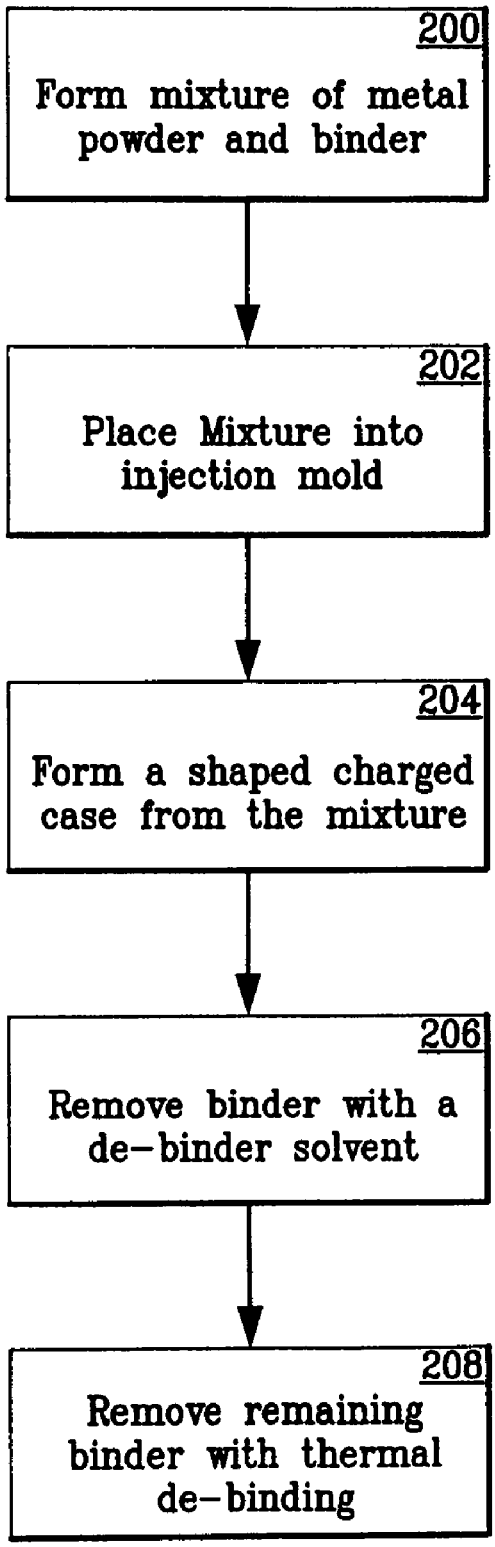
FIG. 7 is an embodiment of a charge case forming process in flow chart form.

It should be pointed out that the shaped charge 5*a* of FIG. 6 has essentially the same configuration as the shaped charge 5 of FIG. 1. FIG. 6 is provided for clarity and to illustrate that shaped charges having the traditional configuration can be formed with a liner 10*a* made in accordance with the disclosure provided herein. Moreover, the formation process disclosed herein can also be applicable for the forming of charge casings or housings. As seen in FIG. 7, a process similar to that of FIG. 2 is illustrated. With regard to the process of FIG. 7, a mixture of metal powder and binder is formed (step 200). The metal powder used in the formation of a charge casing includes the metals used in the liner formation and further comprises steel such as carbon steel and stainless steel and other metals including monel, inconel, as well as aluminum.

Also similar to the process of forming a liner, after mixing the shaped charge casing components, the mixture is directed to an injection mold (step 202). Moreover, the injection mold can be the same as or substantially similar to the injection molding device 12 of FIG. 3. The mixture can be formed prior to being placed in the injection molding device or can be formed while in the injection molding device. Steps 204, 206, and 208 of FIG. 7 are substantially similar to the corresponding steps 104, 106, and 108 of FIG. 2. One difference however between formation of the charge case and liner is that the charge case forming step (step 204) would require a mold having a charge case configuration instead of a liner shaped mold. Also similarly, the present method can involve producing an injection molded charge case without a de-binding step thereby producing a "green part" charge case. Optionally, the process of forming the charge case could include a sintering step as above described. As previously noted, sintering involves heating the composition to above the melting point of one or more of the constituents of the final product. While the sintering temperature and time of sintering depends on the constituent metals and their respective amounts, it is within the scope of those skilled in the art to determine an appropriate sintering temperature, time, as well as other furnace conditions, such as pressure and ambient components.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of forming a shaped charge comprising:

creating a mixture of metal powder and a binder;

molding said mixture into a liner shape with an injection molding device;

debinding the binder from the liner shape to form a liner without sintering, wherein the dimensions of the liner are substantially the same as the dimensions of the liner shape;

adding explosive to a shaped charge case; and inserting the liner into the shaped charge case to form a shaped charge.

2. The method of forming a shaped charge of claim 1, wherein said metal powder is selected from the group consisting of tungsten, uranium, hafnium, tantalum, nickel, copper, molybdenum, lead, bismuth, zinc, tin, silver, gold, antimony, cobalt, zinc alloys, tin alloys, nickel, palladium, coated metal particles, and combinations thereof.

3. The method of forming a shaped charge of claim 1, wherein said binder is selected from the group consisting of a polyolefin, an acrylic resin, a styrene resin, polyvinyl chloride, polyvinylidene chloride, polyamide, polyester, polyether, polyvinyl alcohol, paraffin, a higher fatty acid, a higher alcohol, a higher fatty acid ester, a higher fatty acid amide, a wax-polymer, and combinations thereof.

4. The method of forming a shaped charge liner of claim 1 wherein said step of debinding comprises chemical debinding.

5. The method of forming a shaped charge of claim 1 wherein said step of debinding further comprises treating said liner shape with a debinding agent.

6. The method of forming a shaped charge of claim 5, wherein said debinding agent is selected from the group consisting of water, nitric acid, organic solvents, and combinations thereof.

7. The method of forming a shaped charge of claim 5 further comprising heating said liner shape for removing remaining binder from said liner shape.

8. The method of forming a shaped charge of claim 1 further comprising forming a shaped charge with said shaped charge liner, disposing the shaped charge within a perforating gun, combining the perforating gun with a perforating system, disposing the perforating gun within a wellbore, and detonating the shaped charge.

9. The method of forming a shaped charge of claim 1 wherein said step of debinding comprises thermal debinding.

10. A method of forming a shaped charge comprising:

combining powdered metal with organic binder to form a mixture;

passing the mixture through an injection molding device;

ejecting the mixture from the injection molding device into a mold thereby forming a liner shape in the mold;

debinding the binder from the liner shape to form a liner, wherein the liner shape is not sintered and wherein the liner dimensions are substantially the same as the liner shape dimensions;

adding explosive to a shaped charge case; and inserting the liner into the shaped charge case to form a shaped charge.

11. The method of forming a shaped charge of claim 10 wherein said metal powder is selected from the group consisting of tungsten, uranium, hafnium, tantalum, nickel, copper, molybdenum, lead, bismuth, zinc, tin, silver, gold, antimony, cobalt, zinc alloys, tin alloys, nickel, palladium, coated metal particles, and combinations thereof.

12. The method of forming a shaped charge of claim 10, wherein said binder is selected from the group consisting of polyolefins, acrylic resins, styrene resins, polyvinyl chloride, polyvinylidene chloride, polyamide, polyester, polyether, polyvinyl alcohol, paraffin, higher fatty acids, higher alcohols, higher fatty acid esters, higher fatty acid amides, a wax-polymer, and combinations thereof.

13. The method of forming a shaped charge of claim 10 wherein the step of debinding further comprises adding a debinding agent to the liner shape, wherein the debinding agent is selected from the group consisting of water, nitric acid, and organic solvents.

14. The method of forming a shaped charge of claim 13 further comprising placing the liner shape in a vacuum.

15. The method of forming a shaped charge of claim 10 wherein the step of debinding further comprises heating the liner shape thereby removing residual binder within the liner shape thereby forming a liner product.

16. The method of forming a shaped charge claim 10 further comprising disposing the shaped charge within a perforating gun, combining the perforating gun with a perforating system, disposing the perforating gun within a wellbore, and detonating the shaped charge.

17. A method of forming a shaped charge comprising:

forming a mixture by combining metal powder with a binder;

processing said mixture with an injection molding apparatus;

discharging said mixture into a mold thereby forming said liner;

removing said liner from the mold, without debinding or sintering the liner;

adding explosive to a shaped charge case; and inserting the liner into the shaped charge case thereby forming a shaped charge.

18. The method of forming a shaped charge of claim 17, wherein said metal powder is selected from the group consisting of tungsten, uranium, hafnium, tantalum, nickel, copper, molybdenum, lead, bismuth, zinc, tin, silver, gold, antimony, cobalt, zinc alloys, tin alloys, nickel, palladium, coated metal particles, and combinations thereof.

19. The method of forming a shaped charge of claim 17, wherein said binder is selected from the group consisting of polyolefins, acrylic resins, styrene resins, polyvinyl chloride, polyvinylidene chloride, polyamide, polyester, polyether, polyvinyl alcohol, paraffin, higher fatty acids, higher alcohols, higher fatty acid esters, higher fatty acid amides, wax-polymer, and combinations thereof.

20. The method of forming a shaped charge of claim 17, wherein said liner formed in the mold is a green product.

21. A method of forming a shaped charge comprising:

creating a mixture of metal powder and a binder;

molding said mixture into a charge case shape with an injection molding device; debinding the binder from the charge case shape without sintering to form a shaped charge case, wherein the shaped charge case dimensions are substantially the same as the charge case shape dimensions;

adding explosive into the shaped charge case; and inserting a shaped charge liner into the shaped charge case thereby forming a shaped charge.

22. The method of forming a shaped charge of claim 21, wherein said metal powder is selected from the group consisting of steel, tungsten, uranium, hafnium, tantalum, nickel, copper, molybdenum, lead, bismuth, zinc, tin, silver, gold, antimony, cobalt, zinc alloys, tin alloys, nickel, palladium, monel, inconel, aluminum and combinations thereof.

23. The method of forming a shaped charge of claim 21, wherein said binder is selected from the group consisting of polyolefines, acrylic resins, styrene resins, polyvinyl chloride, polyvinylidene chloride, polyamide, polyester, polyether, polyvinyl alcohol, paraffin, higher fatty acids, higher alcohols, higher fatty acid esters, higher fatty acid amides, wax-polymer, acetyl based, water soluble, agar water based and water soluble/cross-linked.

24. The method of forming a shaped charge of claim 21 wherein said step of debinding comprising chemical debinding and thermal debinding.

25. The method of forming a shaped charge of claim 21 wherein said step of debinding further comprises treating said liner shape with a debinding agent.

26. The method of forming a shaped charge of claim 25, wherein said debinding agent is selected from the group consisting of water, nitric acid, and organic solvents.

27. The method of forming a shaped charge of claim 25 further comprising heating said charge case shape for removing remaining binder from said charge case shape.

28. The method of forming a shaped charge of claim 21 further comprising forming a shaped charge with said shaped charge case, disposing the shaped charge within a perforating gun, combining the perforating gun with a perforating system, disposing the perforating gun within a wellbore, and detonating the shaped charge.

29. The method of forming a shaped charge of claim 21, wherein said case formed in the injection molding device is a green product.

* * * * *